United States Patent [19]

Dean et al.

[11] 3,980,363

[45] Sept. 14, 1976

[54] STORAGE SYSTEM

[75] Inventors: Carl J. Dean, Southbridge; Donald B. McCallum, Douglas; Norman C. May, Sr., Shrewsbury, all of Mass.

[73] Assignee: Barry Wright Corporation, Watertown, Mass.

[22] Filed: Jan. 31, 1975

[21] Appl. No.: 545,872

[52] U.S. Cl. ..... 312/294; 312/322; 312/189; 312/348

[51] Int. Cl.[2] ..... A47B 88/00

[58] Field of Search ..... 312/294, 189, 183, 348, 312/350, 322, 323

[56] References Cited

UNITED STATES PATENTS

| | | | |
|---|---|---|---|
| 564,670 | 7/1896 | Ward | 312/189 |
| 570,308 | 10/1896 | Graf | 312/189 |
| 625,576 | 5/1899 | Macey | 312/348 |
| 631,312 | 8/1899 | Macey | 312/323 |
| 633,459 | 9/1899 | Jordan | 312/189 |
| 741,434 | 10/1903 | Anderson | 312/348 |
| 1,736,655 | 11/1929 | Lombardini | 312/323 |
| 1,764,613 | 6/1930 | Donnelley | 312/183 |
| 1,774,237 | 8/1930 | Rand, Jr. | 312/348 |
| 2,123,803 | 7/1938 | Regenhardt | 312/323 |
| 3,716,282 | 2/1973 | Propst et al. | 312/322 |

FOREIGN PATENTS OR APPLICATIONS

| | | | |
|---|---|---|---|
| 102,757 | 10/1963 | Norway | 312/348 |
| 289,028 | 6/1953 | Switzerland | 312/348 |
| 352,313 | 4/1961 | Switzerland | 312/189 |
| 620,113 | 3/1949 | United Kingdom | 312/348 |

*Primary Examiner*—Paul R. Gilliam
*Assistant Examiner*—Victor N. Sakran
*Attorney, Agent, or Firm*—Milton E. Gilbert

[57] ABSTRACT

System for storing computer printouts or the like which includes a cabinet or shell supporting a plurality of trays which may be removed from the cabinet or be partially pulled out of the cabinet to view a printout supported by the tray. Provision is provided in the preferred embodiment for binding the computer printout to the tray supporting the printout.

4 Claims, 12 Drawing Figures

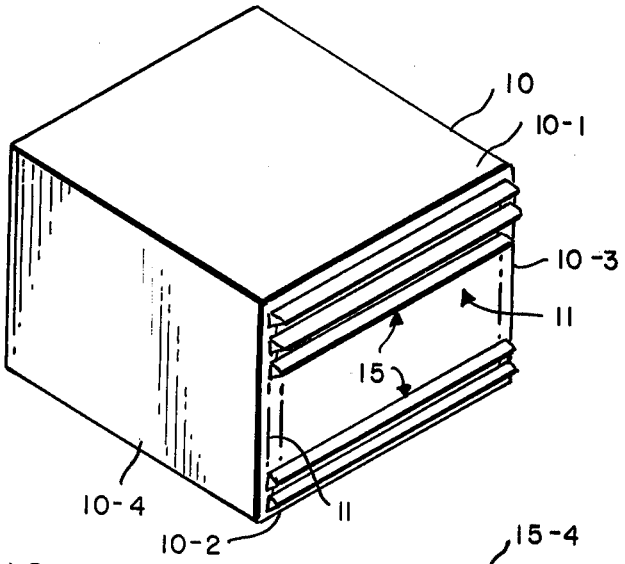
FIG.1
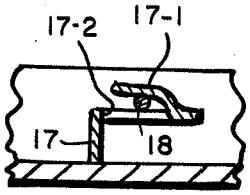
FIG.5
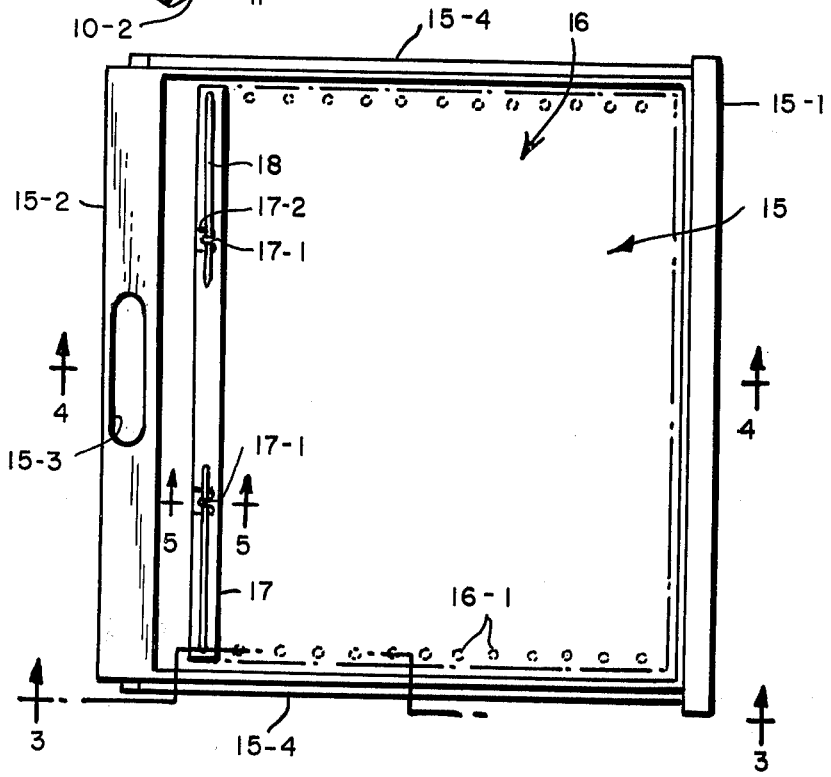
FIG.2
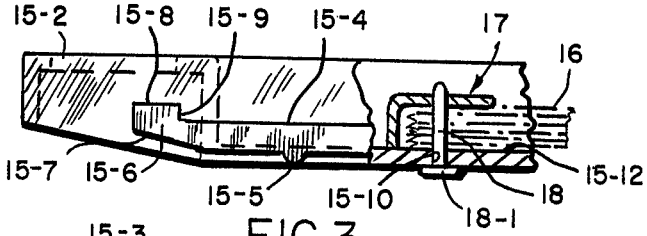
FIG.3
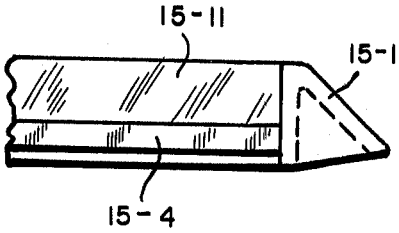
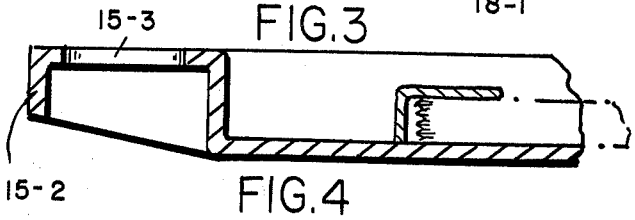
FIG.4
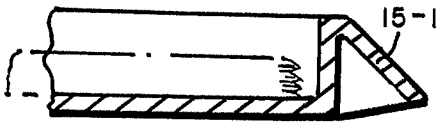

STORAGE SYSTEM

BACKGROUND OF THE DISCLOSURE

The present invention is directed to a new and improved record storage unit or system and is more particularly directed to a new and improved unit or system for storing computer generated printouts or records in sheet form.

Currently, the principle method of storing computer printouts is in binders or hanging folders. In the case of smaller reports which are frequently utilized, binders add considerable cost and bulk and still do not solve the storage problem completely since there is still a requirement for some other storage system to store the binders in a manner in which they may be easily retrieved.

Also, in the case of daily reports, repeated binding and unbinding of the reports is quite costly.

Folders, on the other hand, also require a storage unit or cabinet and will often allow the reports to 'slump', creating curls in the reports which make it difficult to use them repeatedly.

Accordingly, it has become quite evident that a new and improved storage system was needed to store computer generated reports or printouts in a manner so that they would not be destroyed, or distorted in repeated use and could be easily retrieved.

The present invention provides a storage system that provides quick retrieval of forms such as computer printouts and also supports the printouts in such a manner that they may be repeatedly used without causing their destruction. In addition, the preferred form of the invention provides means to bind together a computer printout (in sheet form) so that it may be unfolded for visual observation while attached or coupled to a tray of the storage system or may be removed from the tray by unfastening the means for binding together the computer printout.

BRIEF SUMMARY OF THE DISCLOSURE

The present invention provides a new and improved filing system for reports such as computer printouts in sheet form. The filing or storage system of this invention has additional advantages in that it is easily portable, allows easy insertion and updating of reports, keeps the printouts flat, and provides a rigid support for making entries, e.g., pencil, into the printout sheets without removal from the file.

The preferred form of the invention comprises a cabinet or shell having a plurality of slides or tracks along the sides thereof for supporting one or more trays. The trays include side rails positioned on the slides. The trays may be removed or may be suspended from the shell for viewing of the printout without removing the trays. In the preferred form of the tray, means is provided for binding the sheets of the printout to the top surface of the tray.

In the case of daily reports, which are used and discarded, printouts may be stored in the trays without binding or use of a folder, thereby saving the cost of binding, binders, and folders.

BRIEF DESCRIPTION OF THE DRAWINGS

FIG. 1 is a perspective view illustrating the record storage system or unit according to the preferred form of the invention;

FIG. 2 is a top view of the preferred tray of the record storage system;

FIGS. 3, 4 and 5 are sectional views taken along lines 3—3, 4—4, and 5—5 of FIG. 2;

DETAILED DESCRIPTION OF THE DISCLOSURE

Reference should now be had to FIGS. 1–12 for a description of the preferred embodiment of the invention. At 10 there is shown a cabinet, shell or case open at the front, preferably closed at the back and having a top 10-1, bottom 10-2 and sides 10-3 and 10-4. Two side panels 11 are supported in the shell.

One of the side panels 11 is supported against the interior of side 10-3 and the other of the side panels is supported against the interior of the side 10-4.

The side panels 11 each comprise a backing portion 11-A and a pair of upper and lower tracks or slides 11-1 and 11-2 extending outwardly therefrom (see FIGS. 6 and 7) which serve as guides or positioners for trays 15.

The side panels 11 are attached to the sides 10-3 and 10-4 by screws 12 or other conventional fasteners. It should be understood that the tracks 11-1 and 11-2 could, if desired, be formed at the same time as the shell for example, if the shell was molded of plastic.

Figure 6:
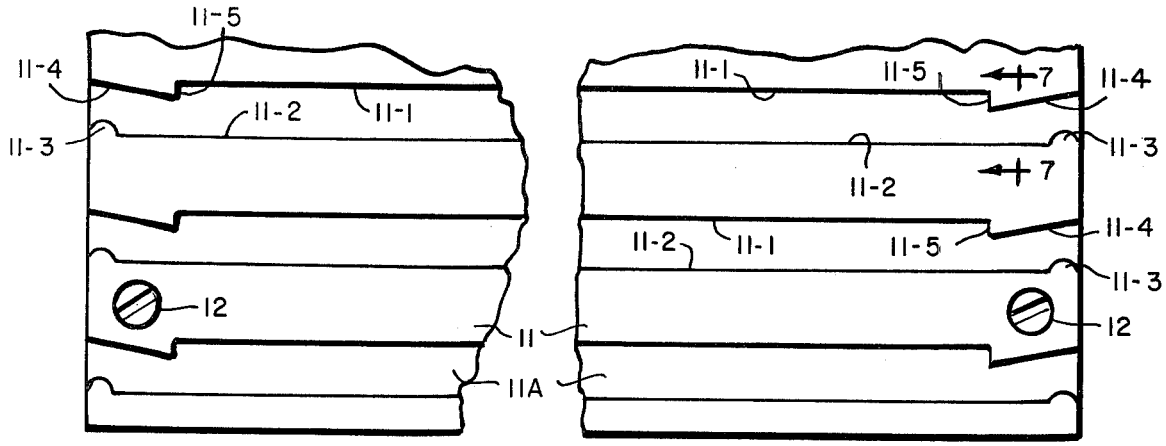
FIG. 6 is a side view of one interior side panel coupled to the side wall of the shell and having slides to support the tray of FIGS. 2 – 5.

As may be seen in FIG. 6 the side panels 11 are preferably constructed with no left or right orientation, so that they may be mounted on either side 10-3 or side 10-4 without having to construct special left or right orientation side panels.

In order to prevent the trays 15 from being removed from the shell 10 without being first subjected to vertical movement, the track 11-2 is constructed with a stop or raised portion 11-3 near the front (opening) of the shell.

The track 11-1 is provided with an incline 11-4 opposite the stop 11-3 to permit the trays 15 to be raised and then removed.

In addition, to the rear of the incline 11-4 there is provided a stop 11-5 which cooperates with a stop 15-9 of the rails 15-4 to permit the trays 15 to be fully suspended horizontally from the shell and locked in place against substantial forward or rearward motion so that a printout 16 supported on the top surface 15-12 of the tray may be visibly observed without completely removing the trays 15 from the shell 10.

The trays 15 include a handle 15-1 which may include a recessed area for labelling. At the opposite end of the trays there is provided a shelf 15-2 having a hand hole 15-3 through which a user may place a hand to transport the tray with a printout bound to it.

Along the sides 15-11 of the trays 15 there are provided the aforementioned rails 15-4 which have a raised portion or stop 15-5 for sliding along the track 11-2.

Figure 8:
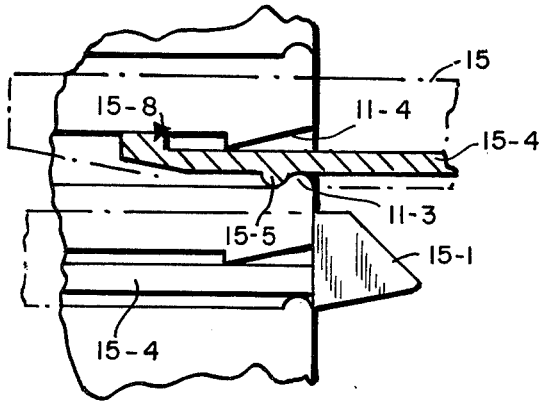
FIG. 8 illustrates a tray shown partially pulled out of the shell.

The stop 15-5 engages stop 11-3 of the tracks when a tray is pulled out as shown in FIG. 8 to prevent further forward movement of the tray without lifting the stop 15-5 over the stop 11-3.

Figure 9:
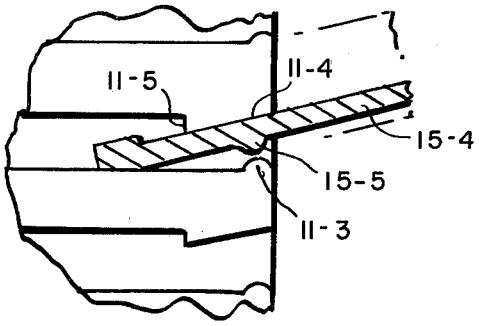
FIGS. 9–11 illustrate in a side view the removal of a tray from the shell.
Figure 10:
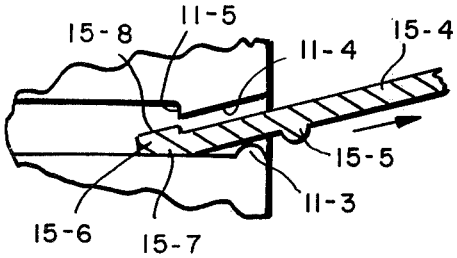
Figure 11:
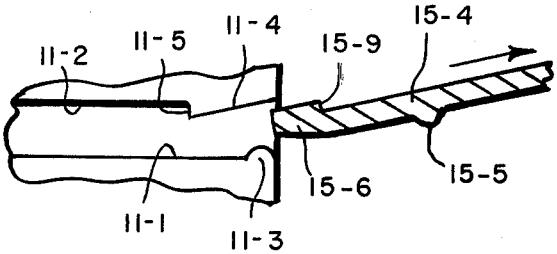
Figure 7:
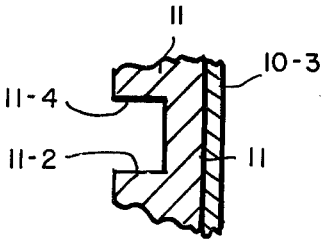
FIG. 7 is a sectional view taken along line 7—7 of FIG. 6 except that the side panel is shown positioned against one of the sides of the shell.

The rails 15-4 include a rear portion 15-6 having an inclined surface 15-7 to permit tilting or rotating of the tray as shown in FIG. 9 to lift the stop 15-5 over the stop 11-3 and ultimately remove the tray as shown in FIGS. 10 and 11 from the shell.

As may be observed, a line defined by incline 11-4 and inclined surface 15-7 if carried back would intersect.

The rear portion 15-6 also includes a levelling surface 15-8 for sliding along the track 11-1 to maintain the tray in a horizontal position as it slides back and forth. The rear portion 15-6 also includes a stop 15-9 for engaging the stop 11-5 as shown in FIG. 12 when the stop 15-5 is lifted beyond the stop 11-3.

Figure 12:
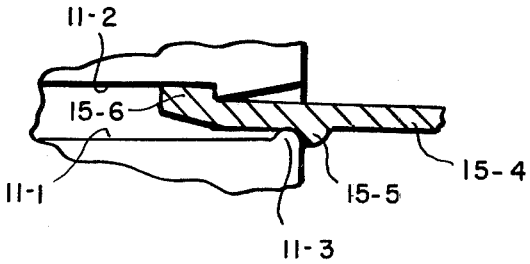
FIG. 12 illustrates in a side view a tray shown in its fully extended position so that the computer printout bound thereto may be visually observed.

When the tray is horizontally suspended as shown in FIG. 12, the tray 15 is locked against both forward and rearward movement since the stop 11-3 abuts stop 15-5 and stop 15-9 abuts stop 11-5.

The preferred embodiment also includes means to confine a computer printout 16 in sheet form (shown in phantom) to the tray 15.

The confining means include an L shaped bracket 17 which rests on the printout 16 (shown in phantom) and includes hold down fingers 17-1 positioned above cutouts 17-2. The printout is confined by binding it when folded, as shown, to the tray 15 top surface 15-12. In order to bind the sheets of the printout there is provided hold down or binding straps 18 which have heads 18-1.

The straps 18 extend through holes 15-10 formed in the tray 15 and the normal feed holes 16-1 formed in the printout sheet 16. The straps are fixed or locked into place by being forced under the fingers 17-1 and against the edges of the hole 17-2.

A plurality of holes are provided for binding and placed in such a manner as to accommodate the many sizes of printouts and their corresponding hole centers. Burst and unburst sheets may be bound across the top or along the side.

It should be understood that the confining means such as the binding means disclosed herein need not be incorporated in the storage system although use of the binding means as disclosed herein is preferred.

It should also be understood that a plate slideably suspended about rods from the bracket therefor 17 and a plurality of set screws may be used in place of the straps 18 to hold down the printout against the tray top surface 15-12 although again the use of binding means such as straps passing through the printout sheet is preferred because of the ease of adding sheets or removing the sheets from the tray.

It will thus be seen that this invention provides a new and improved file system which is particularly well suited to the storage of computer printouts in sheet form. The present invention also provides a structure in which the storage drawers or trays may be easily removed to work on the printout bound to the tray or which may be suspended and locked against rearward and forward motion to permit viewing of or writing on the sheets of the printout.

We claim:

1. Computer printout storage and filing system comprising a tray having a flat surface for supporting a computer printout, storage means for said tray, said tray being removable from said storage means, said tray having a pair of spaced apart holes extending therethrough from the bottom to the top thereof, a bracket positioned above the tray surface for supporting the computer printout, said bracket having a pair of holes, a pair of cutout portions and a hold-down finger positioned over each of said cutouts, and a pair of straps for holding said computer printout between said tray and said bracket and said straps having heads, each strap extending through said separate hole of said pair of holes of said tray and said bracket and held against the bracket by said fingers, the head of said straps abutting the bottom of said tray.

2. The system of claim 1 in which said bracket is L shaped.

3. A storage system comprising a shell open at least at the front, a tray, a pair of first and second slides supported by said shell at opposite sides of the shell for supporting said tray, each of said first slides having a stop means at the mouth thereof and each of said second slides having an incline at the mouth thereof, said tray supporting rails on either side thereof, said rails being supportable between said slides, each of said rails having near the rear thereof a stop on the bottom thereof which abuts the stop of each of said first slides when the tray is moved in a direction to pull it out of said shell and a levelling surface on the rail tops for sliding against the second slide, said incline of each of said second slides including a rear stop and the levelling surfaces each including a forward stop, the spacing between the stop on the bottom of said rails, the forward stop of said levelling surface of said rails, the stop of said first slide, and the stop at the rear of the incline of said second slide being such that the tray is suspendible from the shell with the forward stop of said levelling surface being adjacent to and to the rear of the stop to the rear of the incline of the second slide and the stop of said first slide is adjacent to and to the rear of the stop of the bottom of said rail thereby preventing substantial forward and rearward motion of said tray with respect to said shell.

4. The system according to claim 3 including means for holding a computer printout to the top surface of said tray.

* * * * *